US009901500B2

(12) United States Patent
Nordvik

(10) Patent No.: US 9,901,500 B2
(45) Date of Patent: Feb. 27, 2018

(54) LIFTING ASSEMBLY

(71) Applicant: Michael Nordvik, Champlin, MN (US)

(72) Inventor: Michael Nordvik, Champlin, MN (US)

( * ) Notice: Subject to any disclaimer, the term of this patent is extended or adjusted under 35 U.S.C. 154(b) by 318 days.

(21) Appl. No.: 14/796,429

(22) Filed: Jul. 10, 2015

(65) Prior Publication Data

US 2017/0007484 A1 Jan. 12, 2017

(51) Int. Cl.
*A61G 7/10* (2006.01)

(52) U.S. Cl.
CPC ..... *A61G 7/1017* (2013.01); *A61G 7/1015* (2013.01); *A61G 7/1051* (2013.01); *A61G 7/1007* (2013.01); *A61G 7/1046* (2013.01); *A61G 2200/34* (2013.01); *A61G 2200/50* (2013.01)

(58) Field of Classification Search
CPC .. A61G 7/1017; A61G 7/1015; A61G 7/1051; A61G 7/1007; A61G 7/1046
See application file for complete search history.

(56) References Cited

U.S. PATENT DOCUMENTS 2,625,202 A 1/1953 Richardson et al.
2,854,673 A * 10/1958 Ramsey ..... A61G 7/053 254/124
3,222,029 A * 12/1965 Hildemann ..... A61G 7/1017 254/124
3,568,226 A 3/1971 Mater et al.
3,694,829 A * 10/1972 Bakker ..... A61G 7/1017 5/86.1
4,188,966 A 2/1980 Palmer et al.
4,443,902 A 4/1984 Baer
4,703,523 A * 11/1987 James ..... A61G 7/1017 5/83.1
D327,762 S 7/1992 Silbersky et al.
5,878,450 A 3/1999 Bouhuijs
6,092,247 A * 7/2000 Wilson ..... A61G 7/1011 5/81.1 R
6,119,287 A * 9/2000 Phillips ..... A61G 7/1017 5/81.1 RP
6,175,973 B1 * 1/2001 Hakamiun ..... A61G 7/1017 5/86.1
6,733,018 B2 5/2004 Razon
7,354,382 B1 4/2008 Warren, II
7,506,388 B1 * 3/2009 Brown ..... A61G 7/1017 5/86.1
8,656,529 B2 * 2/2014 Corriveau ..... A61G 7/1017 5/83.1
2011/0016628 A1 1/2011 Masterson, Jr.
2012/0255118 A1 * 10/2012 Hammond ..... A61G 7/1017 5/86.1
2016/0228314 A1 * 8/2016 Tamai ..... A61G 7/1017

* cited by examiner

*Primary Examiner* — Nicholas F Polito

(57) ABSTRACT

A lifting assembly includes a cart that includes a first section, a second section and a third section. Each of the first section, the second section and the third section are removably coupled together. The first section may be rolled along a support surface. A lifting unit is coupled to the cart and the lifting unit is positioned on the second section. The lifting unit selectively urges the third section upwardly with respect to the support surface. The third section may be gripped by a user thereby facilitating the third section to lift the user from a seated position.

14 Claims, 5 Drawing Sheets

LIFTING ASSEMBLY

BACKGROUND OF THE DISCLOSURE

Field of the Disclosure

The disclosure relates to lifting devices and more particularly pertains to a new lifting device for selectively lifting and lowering a user with respect to a seat.

SUMMARY OF THE DISCLOSURE

An embodiment of the disclosure meets the needs presented above by generally comprising a cart that includes a first section, a second section and a third section. Each of the first section, the second section and the third section are removably coupled together. The first section may be rolled along a support surface. A lifting unit is coupled to the cart and the lifting unit is positioned on the second section. The lifting unit selectively urges the third section upwardly with respect to the support surface. The third section may be gripped by a user thereby facilitating the third section to lift the user from a seated position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
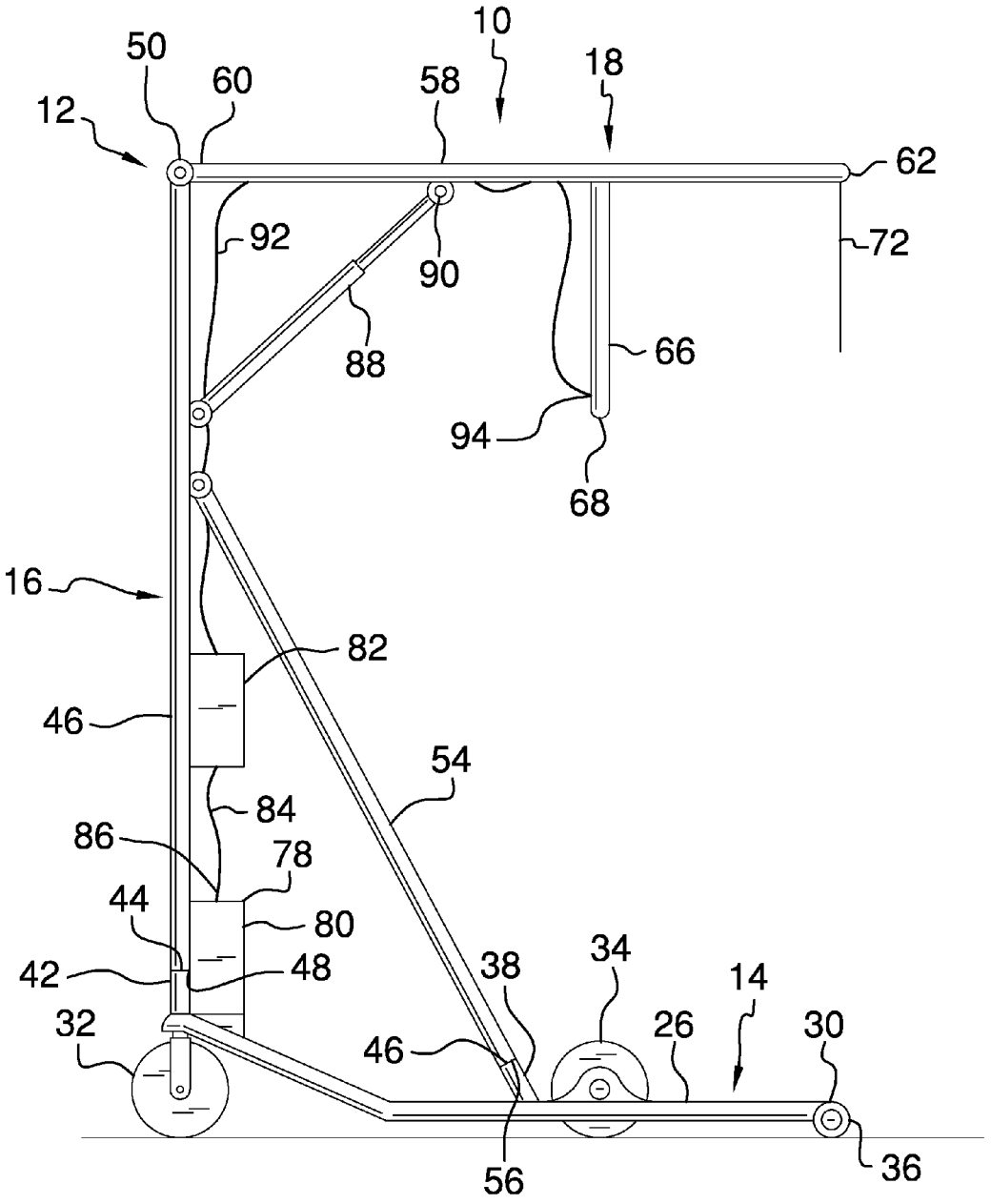
FIG. 1 is a left side view of a lifting assembly according to an embodiment of the disclosure.
Figure 2:
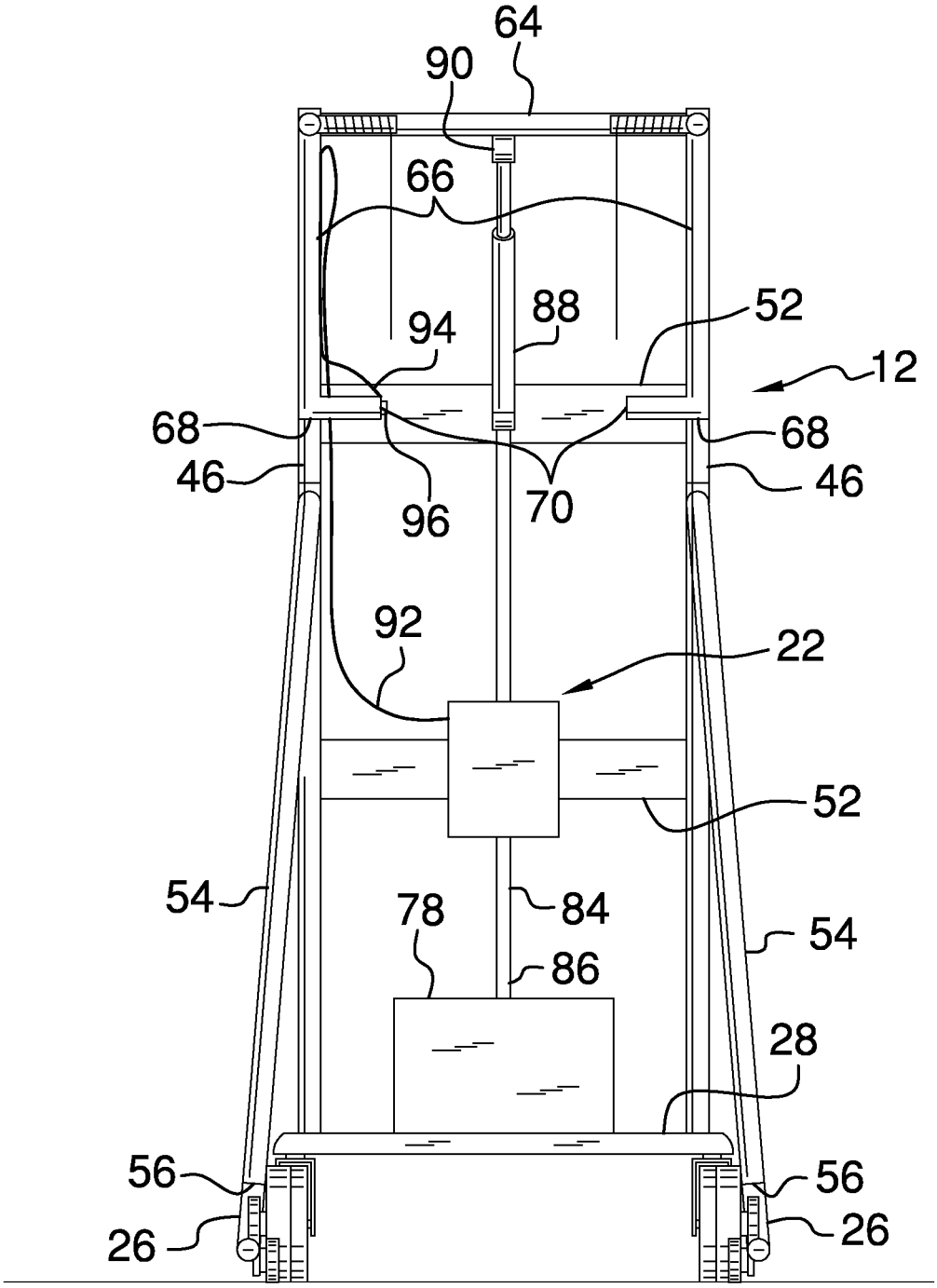
FIG. 2 is a back view of an embodiment of the disclosure.
Figure 3:
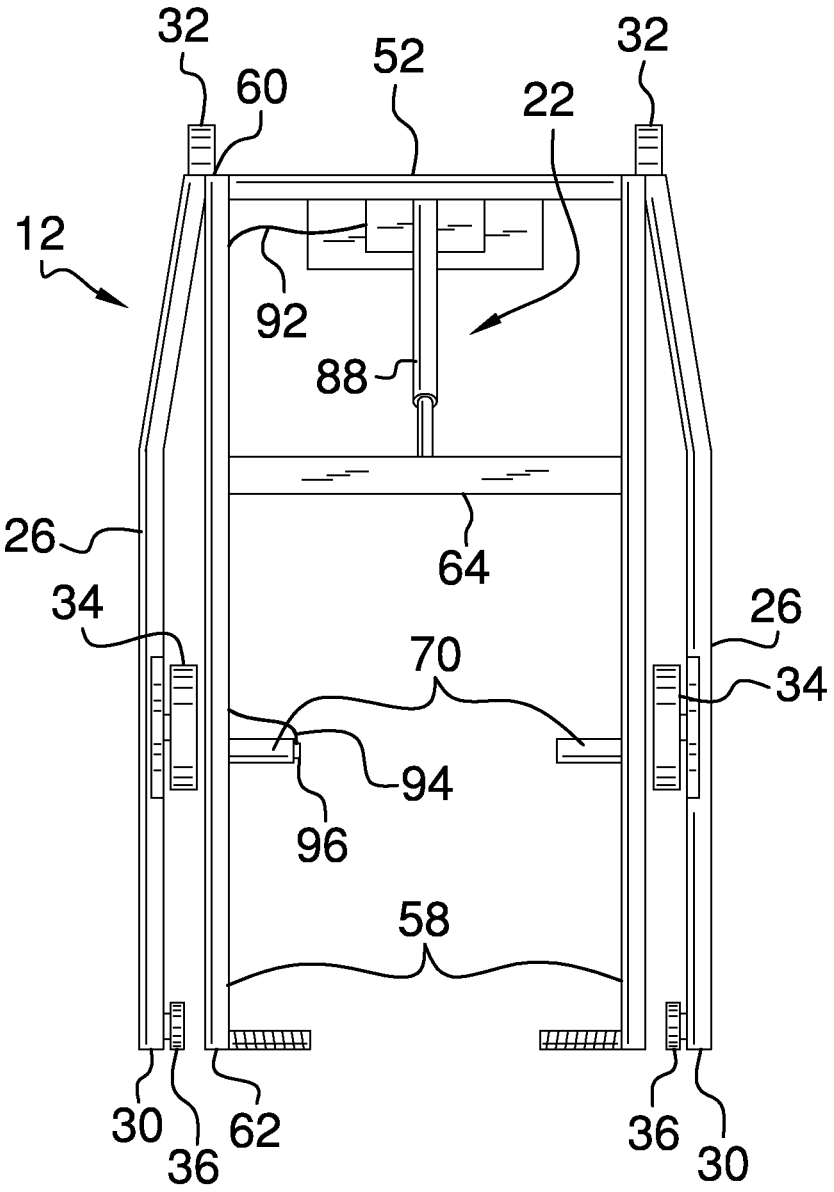
FIG. 3 is a top view of an embodiment of the disclosure.
Figure 4:
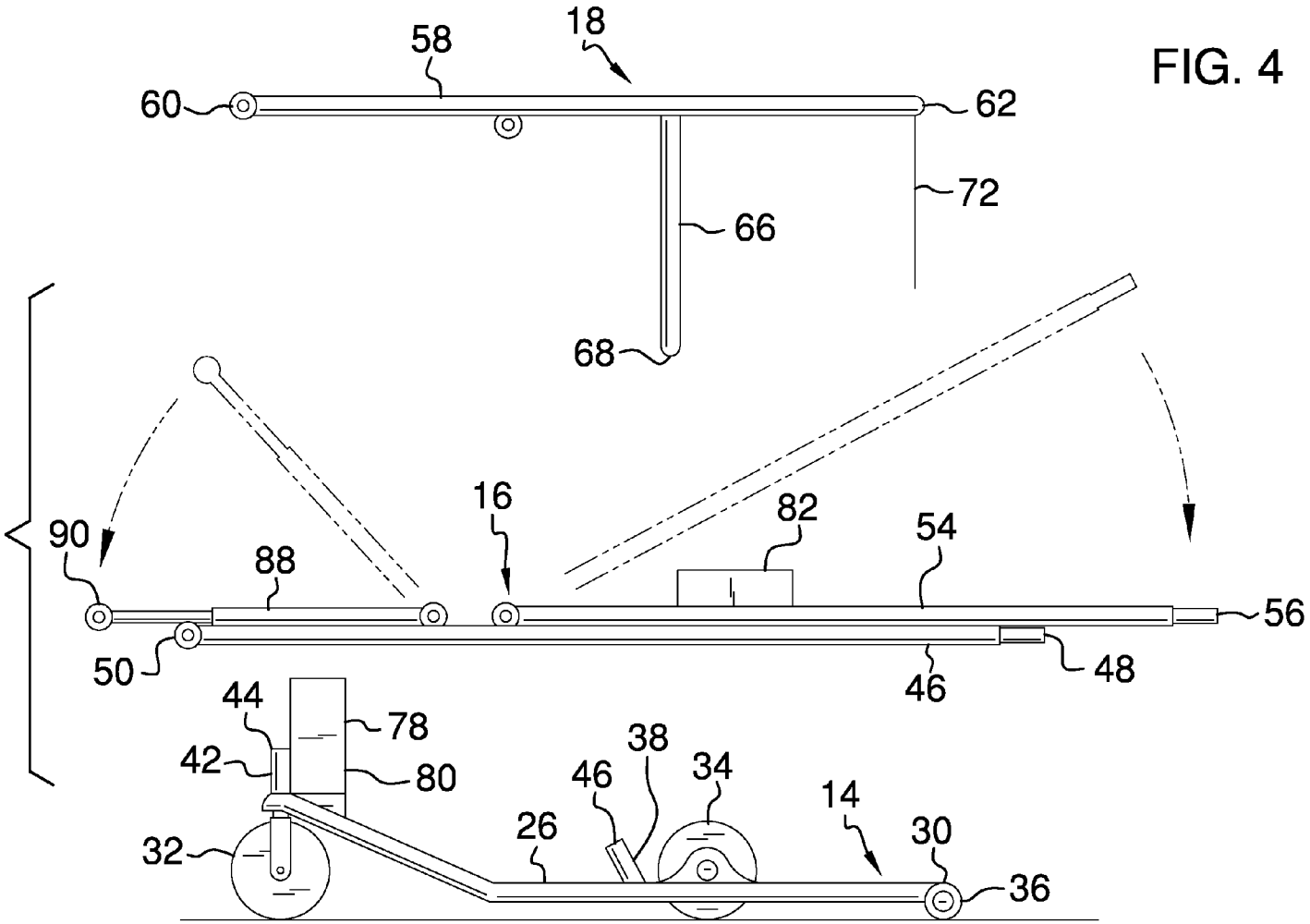
FIG. 4 is an exploded perspective view of an embodiment of the disclosure.
Figure 5:
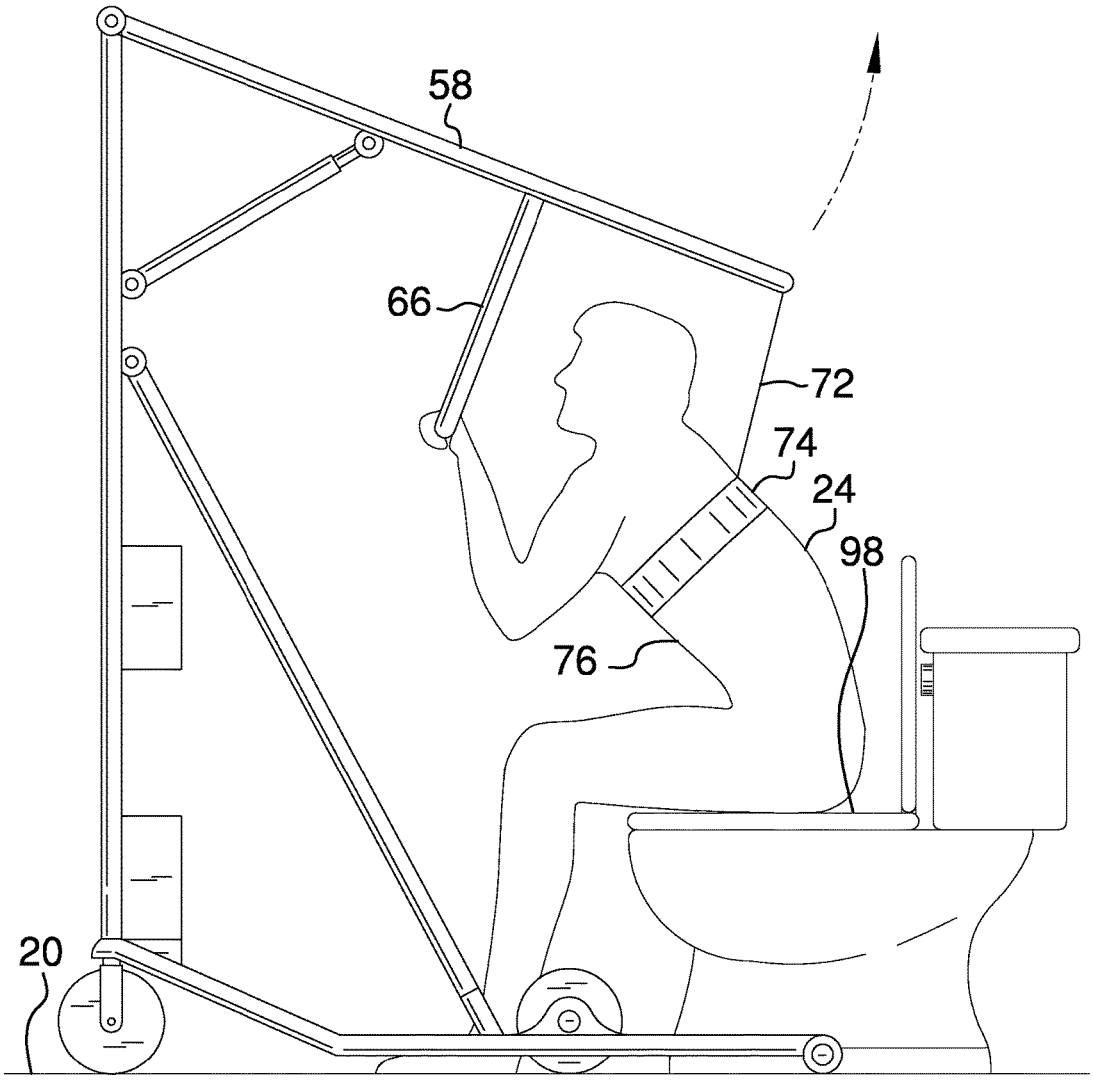
FIG. 5 is a perspective in-use view of an embodiment of the disclosure.

With reference now to the drawings, and in particular to FIGS. 1 through 5 thereof, a new lifting device embodying the principles and concepts of an embodiment of the disclosure and generally designated by the reference numeral 10 will be described.

As best illustrated in FIGS. 1 through 5, the lifting assembly 10 generally comprises a cart 12 that includes a first section 14, a second section 16 and a third section 18. Each of the first section 14, the second section 16 and the third section 18 are removably coupled together. The first section 14 may be rolled along a support surface 20 and the support surface 20 may be a floor or the like. The first section 14, the second section 16 and the third section 18 may be uncoupled from each other thereby facilitating the cart 12 to be stored.

A lifting unit 22 is provided and the lifting unit 22 is coupled to the cart 12. The lifting unit 22 is positioned on the second section 16. The lifting unit 22 selectively urges the third section 18 upwardly with respect to the support surface 20. The third section 18 may be gripped by a user 24 thereby facilitating the third section 18 to lift the user 24 from a seated position. The user 24 may be an elderly person or a physically disabled person.

The first section 14 comprises a pair of first members 26 and a second member 28. The second member 28 is coupled between each of the first members 26. The first members 26 are spaced apart from each other such that the first section 14 has a U-shape. Each of the first members 26 has a distal end 30 with respect to the second member 28. Each of the first members 26 angles outwardly between the second member 28 and a middle 30 of the first members 26. Each of the first members 26 angles upwardly between the middle 30 of the first members 26 and the second member 28.

A pair of first wheels 32 is provided and each of the first wheels 32 is rotatably coupled to the second member 28. Each of the first wheels 32 is positioned at an intersection of an associated one of the first members 26 and the second member 28. Each of the first wheels 32 may roll along the support surface 20. Each of the first wheels 32 may be locking wheels or the like thereby facilitating each of the first wheels 32 to be locked. Thus, the first section 14 is selectively prevented from rolling on the support surface 20.

A pair of second wheels 34 is provided. Each of the second wheels 34 is rotatably coupled to an associated one of the first members 26. Each of the second wheels 34 is positioned between the second member 28 and the distal end 30 of the associated first member 26. Each of the second wheels 34 may roll along the support surface 20.

A pair of third wheels 36 is provided. Each of the third wheels 36 is rotatably coupled to an associated one of the first members 26. Each of the third wheels 36 is positioned on the distal end 30 of the associated first member 26. Each of the third wheels may 36 roll along the support surface 20.

A pair of first sleeves 38 is provided and each of the first sleeves 38 is coupled to and extends upwardly from an associated one of the first members 26. Each of the first sleeves 38 angles toward the second member 28. Each of the first sleeves 38 has a distal end 40 with respect to the associated first member 26 and the distal end 40 of each of the first sleeves 38 is open. A pair of second sleeves 42 is provided and each of the second sleeves 42 is coupled to and extends upwardly from the second member 28. Each of the second sleeves 42 is positioned at an intersection of the second member 28 and an associated one of the first members 26. Each of the second sleeves 42 has a distal end 44 with respect to the second member 28 and the distal end 44 of each of the second sleeves 42 is open.

The second section 16 comprises a pair of primary members 46 and each of the primary members 46 has a bottom end 48 and a top end 50. The distal end 44 of each of the second sleeves 42 insertably receives the bottom end 48 of an associated one of the primary members 46. Thus, the second section 16 extends upwardly from the first section 14. A pair of cross members 52 is each coupled between each of the primary members 46 such that the primary members 46 are spaced apart from each other. Each of the cross members 52 is spaced apart from each other.

A pair of secondary members 54 is each hingedly coupled to an associated one of the primary members 46. Each of the secondary members 54 is positionable in a stored position having the secondary members 54 being coextensive with the associated primary member 46. Each of the secondary members 54 is positionable in a deployed position having each of the secondary members 54 angling away from the associated primary member 46. Each of the secondary members 54 has a distal end 56 with respect to the primary members 46. The distal end 40 of each of the first sleeves 38 insertably receives the distal end 56 of an associated one of the secondary members 54 when the associated secondary member 54 is positioned in the deployed position.

The third section 18 comprises a pair of lifting members 58 and each of the lifting members 58 has a first end 60 and a second end 62. The first end 60 of each of the lifting members 58 is selectively hingedly coupled to the top end 50 of an associated one of the primary members 46. Each of the lifting members 58 is substantially aligned with an associated one of the first members 26. A support 64 is coupled between the lifting members 58 and the support 64 is centrally positioned on the lifting members 58.

A pair of handles 66 is provided and each of the handles 66 is coupled to and extends downwardly from an associated one of the lifting members 58. Each of the handles 66 has a distal end 68 with respect to the lifting members 58. Each of the handles 66 is centrally positioned along the associated lifting member 58. A pair of grips 70 is each coupled to the distal end 68 of an associated one of the handles 66. Each of the grips 70 may be gripped by the user 24.

A strap 72 is coupled to the second end 62 of each of the lifting members 58. A belt 74 is provided and the belt 74 is attached to the strap 72. The belt 74 may be coupled around a waist 76 of the user 24. Thus, the user 24 is coupled to the third section 18 thereby facilitating the third section 18 to selectively lift and lower the user 24.

The lifting unit 22 comprises a power supply 78 that is coupled to the second member 28 of the first section 14. The power supply 78 may comprise at least one battery 80. A pump 82 is coupled to one of the cross members 52 of the second section 16. The pump 82 may comprise a hydraulic pump or the like.

A first conductor 84 is electrically coupled to the pump 82. The first conductor 84 has a distal end 86 with respect to the pump 82. The distal end 86 of the first conductor 84 is selectively electrically coupled to the battery 80. Thus, the battery 80 supplies electrical power to the pump 82.

An actuator 88 is coupled to one of the cross members 52 of the second section 14. The actuator 88 is fluidly coupled to the pump 82 such that the pump 82 urges the actuator 88 between an extended position and a retracted position. The actuator 88 has a distal end 90 with respect to the cross member 52. The distal end 90 of the actuator 88 is selectively hingedly coupled to the support 64 on the third section 18 such that the actuator 88 selectively lifts and lowers the third section 18. Thus, the user 24 may be selectively lifted and lowered and the actuator 88 may comprise a hydraulic piston or the like.

A second conductor 92 is electrically coupled to the pump 82. The second conductor 92 has a distal end 94 with respect to the pump 82. A switch 96 is coupled to one of the grips 70 such that the switch 96 may be manipulated. The switch 96 is selectively electrically coupled to the distal end 94 of the second conductor 92 such that the switch 96 actuates the pump 82 to extend and retract the actuator 88.

In use, the first section 14, the second section 16 and the third section 18 are coupled together. The distal end 86 of the first conductor 84 is electrically coupled to the battery 80 and the distal end 94 of the second conductor 92 is electrically coupled to the switch 96. The user 24 positions the cart 12 proximate a seat 98 that the user 24 wishes to sit upon. The user 24 couples the belt 74 around the user's waist 76 and the user 24 grips each of the grips 70. The switch 96 is manipulated to actuate the actuator 88 to lower the user 24 onto the seat 98. The switch 96 is manipulated to actuate the actuator 88 to lift the user 24 upwardly from the seat 98. The cart 12 is utilized in the convention of a walker when the cart 12 is not utilized to lift or lower the user 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lifting assembly configured to lift a user from a seated position, said assembly comprising:

a cart comprising a first section, a second section and a third section, each of said first section, said second section and said third section being removably coupled together, said first section being configured to be rolled along a support surface, wherein said first section comprises a pair of first members and a second member, said second member being coupled between each of said first members, said first members being spaced apart from each other such that said first section has a U-shape, and each of said first members having a distal end with respect to said second member, each of said first members angling outwardly between said second member and a middle of said first members, each of said first members angling upwardly between said middle of said first members and said second member, and wherein said second section comprises a pair of primary members, each of said primary members having a bottom end and a top end, each of a pair of second sleeves insertably receiving said bottom end of an associated one of said primary members such that said second section extends upwardly from said first section, a pair of cross members, each of said cross members being coupled between each of said primary members such that said primary members are spaced apart from each other, each of said cross members being spaced apart from each other, and a pair of secondary members, each of said secondary members being coupled to an associated one of said primary members, each of said secondary members being positionable in a deployed position having each of said secondary members angling away from said associated primary member and being coupled to an associated one of said first members, wherein said third section comprises a pair of lifting members, each of said lifting members having a first end and a second end, said first end of each of said lifting members being directly hingedly coupled to said top end of an associated one of said primary members such that each of said lifting members is substantially aligned with an associated one of said first members, and a support being coupled between said lifting members, said support being centrally positioned on said lifting members; and a lifting unit being coupled to said cart, said lifting unit being positioned on said second section, said lifting unit selectively urging said third section upwardly with respect to the support surface, said third section being configured to be gripped by a user thereby facilitating said third section to lift the user from a seated position, wherein said lifting unit comprises a power supply being coupled to a second member of said first section; and a pump being coupled to one of pair of cross members of said second section.

2. The assembly according to claim 1, further comprising a pair of first wheels, each of said first wheels being rotatably coupled to said second member, each of said first wheels being positioned at an intersection of an associated one of said first members and said second member, each of said first wheels being configured to be rolled along the support surface.

3. The assembly according to claim 1, further comprising a pair of second wheels, each of said second wheels being rotatably coupled to an associated one of said first members, each of said second wheels being positioned between said second member and said distal end of said associated first member, each of said second wheels being configured to be rolled along the support surface.

4. The assembly according to claim 1, further comprising a pair of third wheels, each of said third wheels being rotatably coupled to an associated one of said first members, each of said third wheels being positioned on said distal end of said associated first member, each of said third wheels being configured to be rolled along the support surface.

5. The assembly according to claim 1, further comprising:

a pair of first sleeves, each of said first sleeves being coupled to and extending upwardly from an associated one of said first members, each of said first sleeves angling toward said second member, each of said first sleeves having a distal end with said associated first member, said distal end of each of said first sleeves being open; and a pair of second sleeves, each of said second sleeves being coupled to and extending upwardly from said second member, each of said second sleeves being positioned at an intersection of said second member and an associated one of said first members.

6. The assembly according to claim 1, further comprising:

each of said secondary members being hingedly coupled to an associated one of said primary members, each of said secondary members being positionable in a stored position having said secondary members being coextensive with said associated primary member; and each of said secondary members having a distal end with respect to said primary members, each of a pair of first sleeves insertably receiving said distal end of an associated one of said secondary members when said associated secondary member is positioned in said deployed position.

7. The assembly according to claim 1, further comprising a pair of handles, each of said handles being coupled to an extending downwardly from an associated one of said lifting members, each of said handles having a distal end with respect to said lifting members, each of said handles being centrally positioned along said associated lifting member.

8. The assembly according to claim 7, further comprising a pair of grips, each of said grips being coupled to said distal end of an associated one of said handles, each of said grips being configured to be gripped by the user.

9. The assembly according to claim 1, further comprising a strap being coupled to said second end of each of said lifting members, said strap being configured to be coupled around a waist of the user.

10. The assembly according to claim 1, further comprising a conductor being electrically coupled to said pump, said conductor having a distal end with respect to said pump, said distal end of said conductor being selectively electrically coupled to said power supply such that said power supply supplies electrical power to said pump.

11. The assembly according to claim 1, further comprising an actuator being coupled to one of said cross members of said second section, said actuator being fluidly coupled to said pump such that said pump urges said actuator between an extended position and a retracted position.

12. The assembly according to claim 11, wherein said actuator has a distal end with respect to said cross member, said distal end of said actuator being selectively hingedly coupled to a support such that said actuator selectively lifts and lowers said third section thereby facilitating the user to be selectively lifted and lowered.

13. The assembly according to claim 1, further comprising:

an actuator being fluidly coupled to said pump;

a second conductor being electrically coupled to said pump, said second conductor having a distal end with respect to said pump; and a switch being coupled to one of a pair of grips wherein said switch is configured to be manipulated, said switch being selectively electrically coupled to said distal end of said second conductor such that said switch actuates said pump to extend and retract said actuator.

14. A lifting assembly configured to lift a user from a seated position, said assembly comprising:

a cart comprising a first section, a second section and a third section, each of said first section, said second section and said third section being removably coupled together, said first section being configured to be rolled along a support surface;

a lifting unit being coupled to said cart, said lifting unit being positioned on said second section, said lifting unit selectively urging said third section upwardly with respect to the support surface, said third section being configured to be gripped by a user thereby facilitating said third section to lift the user from a seated position;

said first section comprising:

a pair of first members and a second member, said second member being coupled between each of said first members, said first members being spaced apart from each other such that said first section has a U-shape, each of said first members having a distal end with respect to said second member, each of said first members angling outwardly between said second member and a middle of said first members, each of said first members angling upwardly between said middle of said first members and said second member, a pair of first wheels, each of said first wheels being rotatably coupled to said second member, each of said first wheels being positioned at an intersection of an associated one of said first members and said second member, each of said first wheels being configured to be rolled along the support surface, a pair of second wheels, each of said second wheels being rotatably coupled to an associated one of said first members, each of said second wheels being positioned between said second member and said distal end of said associated first member, each of said second wheels being configured to be rolled along the support surface, a pair of third wheels, each of said third wheels being rotatably coupled to an associated one of said first members, each of said third wheels being positioned on said distal end of said associated first member, each of said third wheels being configured to be rolled along the support surface, a pair of first sleeves, each of said first sleeves being coupled to and extending upwardly from an associated one of said first members, each of said first sleeves angling toward said second member, each of said first sleeves having a distal end with said associated first member, said distal end of each of said first sleeves being open, and a pair of second sleeves, each of said second sleeves being coupled to and extending upwardly from said second member, each of said second sleeves being positioned at an intersection of said second member and an associated one of said first members;

said second section comprising:

a pair of primary members, each of said primary members having a bottom end and a top end, each of said second sleeves insertably receiving said bottom end of an associated one of said primary members such that said second section extends upwardly from said first section, a pair of cross members, each of said cross members being coupled between each of said primary members such that said primary members are spaced apart from each other, each of said cross members being spaced apart from each other, and a pair of secondary members, each of said secondary members being hingedly coupled to an associated one of said primary members, each of said secondary members being positionable in a stored position having said secondary members being coextensive with said associated primary member, each of said secondary members being positionable in a deployed position having each of said secondary members angling away from said associated primary member, each of said secondary members having a distal end with respect to said primary members, each of said first sleeves insertably receiving said distal end of an associated one of said secondary members when said associated secondary member is positioned in said deployed position;

said third section comprising:

a pair of lifting members, each of said lifting members having a first end and a second end, said first end of each of said lifting members being selectively hingedly coupled to said top end of an associated one of said primary members such that each of said lifting members is substantially aligned with an associated one of said first members, a support being coupled between said lifting members, said support being centrally positioned on said lifting members, a pair of handles, each of said handles being coupled to an extending downwardly from an associated one of said lifting members, each of said handles having a distal end with respect to said lifting members, each of said handles being centrally positioned along said associated lifting member, a pair of grips, each of said grips being coupled to said distal end of an associated one of said handles, each of said grips being configured to be gripped by the user, and a strap being coupled to said second end of each of said lifting members, said strap being configured to be coupled around a waist of the user; and said lifting unit comprising:

a power supply being coupled to said second member of said first section;

a pump being coupled to one of said cross members of said second section, a first conductor being electrically coupled to said pump, said first conductor having a distal end with respect to said pump, said distal end of said first conductor being selectively electrically coupled to said power supply such that said power supply supplies electrical power to said pump, an actuator being coupled to one of said cross members of said second section, said actuator being fluidly coupled to said pump such that said pump urges said actuator between an extended position and a retracted position, said actuator having a distal end with respect to said cross member, said distal end of said actuator being selectively hingedly coupled to said support such that said actuator selectively lifts and lowers said third section thereby facilitating the user to be selectively lifted and lowered, a second conductor being electrically coupled to said pump, said second conductor having a distal end with respect to said pump, and a switch being coupled to one of said grips wherein said switch is configured to be manipulated, said switch being selectively electrically coupled to said distal end of said second conductor such that said switch actuates said pump to extend and retract said actuator.

* * * * *